US012292269B2

(12) United States Patent
Kaakkola

(10) Patent No.: US 12,292,269 B2
(45) Date of Patent: May 6, 2025

(54) PROJECTILE

(71) Applicant: EX CORPORATION OY, Helsinki (FI)

(72) Inventor: Eero Kaakkola, Taichung (TW)

(73) Assignee: EX CORPORATION OY, Helsinki (FI)

( * ) Notice: Subject to any disclaimer, the term of this patent is extended or adjusted under 35 U.S.C. 154(b) by 0 days.

(21) Appl. No.: 18/641,513

(22) Filed: Apr. 22, 2024

(65) Prior Publication Data

US 2024/0280351 A1 Aug. 22, 2024

Related U.S. Application Data

(63) Continuation of application No. 18/248,459, filed as application No. PCT/FI2020/050674 on Oct. 13, 2020, now Pat. No. 11,994,373.

(51) Int. Cl.
*F42B 6/10* (2006.01)
*F42B 33/02* (2006.01)

(52) U.S. Cl.
CPC ..... *F42B 6/10* (2013.01); *F42B 33/02* (2013.01)

(58) Field of Classification Search
CPC .. F42B 6/10; F42B 12/36; F42B 12/40; F42B 12/74; F42B 12/76
USPC ..... 473/569
See application file for complete search history.

(56) References Cited

U.S. PATENT DOCUMENTS 3,649,020 A 3/1972 Hall
4,128,059 A 12/1978 Black
5,035,183 A * 7/1991 Luxton ..... F42B 12/40 473/577
5,654,524 A 8/1997 Saxby
8,875,634 B2 * 11/2014 Gibson ..... F42B 12/40 102/513
9,766,049 B2 * 9/2017 Gibson ..... F42B 10/44
10,295,319 B2 * 5/2019 Gibson ..... F42B 12/40
2005/0066849 A1 3/2005 Kapeles et al.
(Continued)

FOREIGN PATENT DOCUMENTS

WO 2005008165 A2 1/2005
WO 2018078391 A2 5/2018

OTHER PUBLICATIONS

International Preliminary Report on Patentability in Application No. PCT/FI2020/050674, mailed Jan. 16, 2023, 23 pages.
(Continued)

*Primary Examiner* — Jonathan C Weber
(74) *Attorney, Agent, or Firm* — Meunier Carlin & Curfman LLC

(57) ABSTRACT

The invention relates to a paintball projectile comprising a front portion and a body portion, which body portion comprises a side wall. The paintball projectile comprises a body component, which is a single piece forming outer surfaces of the front portion and the side wall, a closed cavity in the interior volume of the front portion, a fill in the closed cavity, and a middle component in the interior volume of the body component, the middle component having a first side and a second side. The first side of the middle component is facing the closed cavity, and the projectile further comprises a barrier layer on the second side of the middle component. The invention further relates to a method for manufacturing paintball projectile.

17 Claims, 6 Drawing Sheets

(56) References Cited

U.S. PATENT DOCUMENTS

| | | | | |
|---|---|---|---|---|
| 2008/0178728 | A1 | 7/2008 | Kapeles et al. | |
| 2008/0178758 | A1 | 7/2008 | Kapeles et al. | |
| 2009/0101038 | A1 | 4/2009 | Kapeles et al. | |
| 2010/0083862 | A1 | 4/2010 | Ciesiun et al. | |
| 2012/0199034 | A1* | 8/2012 | Gibson | F42B 12/40 102/517 |
| 2016/0216089 | A1 | 7/2016 | Gibson et al. | |
| 2017/0160064 | A1 | 6/2017 | Isaacson | |
| 2020/0408494 | A1 | 12/2020 | Kralj | |

OTHER PUBLICATIONS

International Search Report and Written Opinion in Application No. PCT/FI2020/050674, mailed Jun. 18, 2021, 11 pages.
Written Opinion in Application No. PCT/FI2020/050674, mailed Jan. 14, 2022, 6 pages.

* cited by examiner

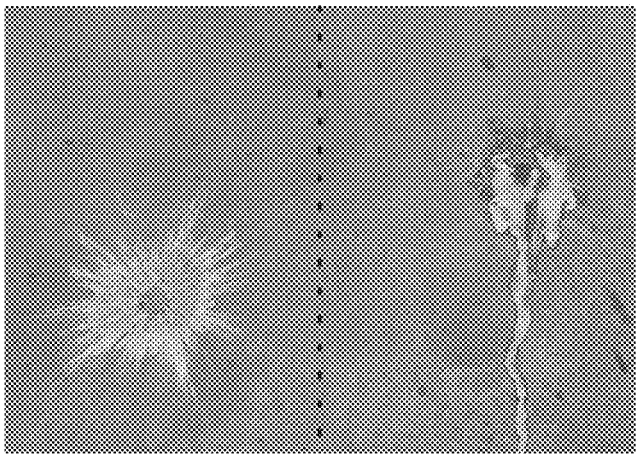
Fig. 6a
Fig. 6b
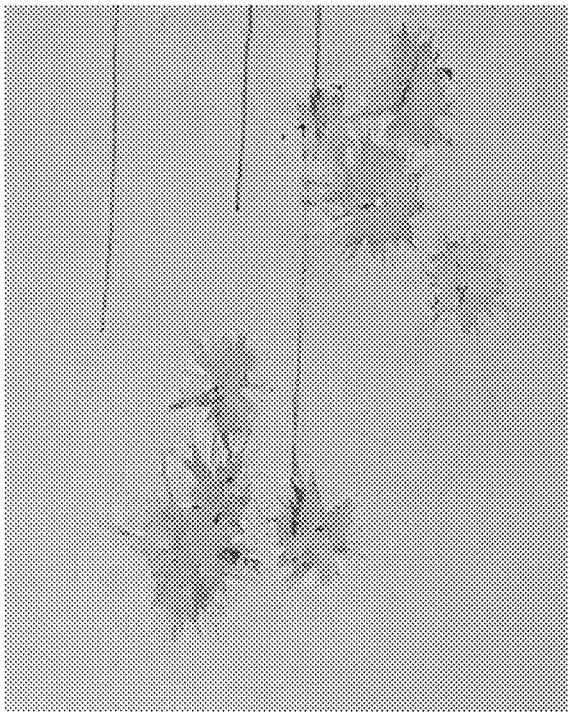
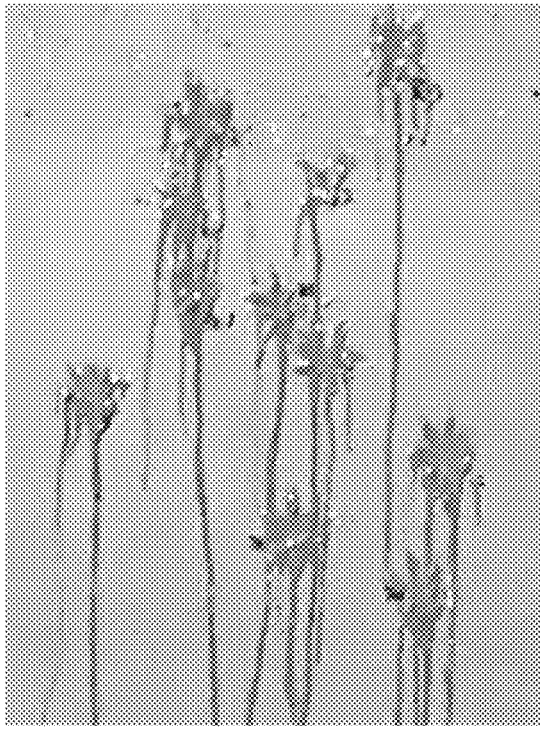
Fig. 6c
Fig. 6d

PROJECTILE

CROSS REFERENCES

This is a continuation application of U.S. patent application Ser. No. 18/248,459 filed on Apr. 10, 2023, which is a U.S. National Stage Application of PCT/FI2020/050674 filed on Oct. 13, 2020.

FIELD OF THE INVENTION

The invention relates to a non-lethal projectile. The invention further relates to a method for manufacturing a non-lethal projectile.

BACKGROUND OF THE INVENTION

In industry, a large variety of projectiles is manufactured. Projectiles may be divided into two main groups: non-lethal and lethal projectiles. The non-lethal projectiles can be used, e.g., for controlling, practicing, or playing purpose.

The non-lethal projectiles for playing purpose include paintball projectiles. The paintball projectiles should have a good aerodynamic performance and suitable strength properties to be efficiently used in a paintball game. Further, the paintball projectiles should not cause too much damage to individuals when used according to typical paintball playing rules. Several different kinds of structures as well as materials have been used for paintballs projectiles. However, there is still need for novel paintball projectiles.

SUMMARY

This invention relates to a non-lethal projectile, and particularly to a non-lethal projectile to be fired using a paintball gun. Thus, it is an aim of this invention to present a non-lethal projectile, particularly a paintball projectile. Furthermore, it is an aim of this invention to present a method for manufacturing non-lethal projectiles, particularly paintball projectiles.

Aspects of the invention are characterized by what is stated in the independent claims. Preferred embodiments are disclosed in the dependent claims. These and other embodiments are disclosed in the description and figures.

The projectile can comprise a front portion and a body portion, which body portion can comprise a side wall.

The projectile may comprise

- a body component, which can be a single piece forming outer surfaces of the front portion and the side wall
- a closed cavity in the interior volume of the front portion,
- a fill in the closed cavity,
- an open cavity in the interior volume of the body portion, and
- a middle component in the interior volume of the body component, the middle component having a first side and a second side.

The first side of the middle component can face the closed cavity. The second side of the middle component may face the open cavity. The projectile can comprise a barrier layer on the second side of the middle component.

In an embodiment, the projectile may comprise only one closed cavity. The only one closed cavity is preferably in the interior volume of the front portion.

The body component may comprise a first biocomposite comprising bioplastic and cellulose based fibers. Further, the middle component may comprise a second biocomposite comprising bioplastic and cellulose based fibers. Said second biocomposite preferably differs from said first biocomposite.

The body component may comprise cellulose based fibers in a range between 20 wt. % and 60 wt. %, calculated from the total weight of the body component. Preferably, the cellulose-based fibers comprise fibers from coffee grounds. The amount of fibers from the coffee grounds may be in a range between 20 wt. % and 60 wt. %, calculated from the total weight of the body component.

The middle component may comprise cellulose based fibers in a range between 5 wt. % and 25 wt. %, calculated from the total weight of the middle component. The cellulose-based fibers may comprise fibers from bamboo. The amount of fibers from bamboo may be in a range between 5 wt. % and 25 wt. %, calculated from the total weight of the middle component.

The body component may comprise at least one bioplastic from a group comprising:

polylactic acid (polylactide) (PLA),
thermoplastic starch,
polyvinyl alcohol (PVOH),
biopolyester,
polyhydroxyalkanoate PHA, and
bioplastic originating from cellulose based material.

The total amount of said bioplastics may be equal to or more than 20 wt. %, and equal to or less than 60 wt. % calculated from the total weight of the body component. In an advantageous embodiment, the body component comprises PLA.

The middle component may comprise at least one biopolymer from the following group comprising:

polylactic acid (polylactide) PLA,
thermoplastic starch,
polyvinyl alcohol,
biopolyester,
polyhydroxyalkanoate PHA, and
bioplastic originating from cellulose based material.

The total amount of said biopolymers is preferably equal to or more than 40 wt. %, and equal to or less than 95 wt. % calculated from the total weight of the middle component. In an advantageous embodiment, the middle component comprises PLA.

The barrier layer may comprise shellac. Preferably the amount of shellac is in a range between 90 wt. % and 100 wt. %, calculated from the total weight of the barrier layer.

The body component can have a smooth outer surface. Preferably, the projectile has a hemispherical front portion. Further, the projectile may have a cylindrical side wall. Most preferably, the projectile may have a tapered cylindrical side wall.

The fill may comprise barium sulfate. Preferably, the fill comprises barium sulfate in a range between 1.1 g and 1.6 g calculated from the total weight of the fill. Further, the fill may comprise laponite. Preferably, the fill comprises laponite in a range between 1 wt. % and 5 wt. % calculated from the total weight of the fill. The fill is preferably water-based fill comprising non-toxic dye.

The middle component may have a thickness in a range between 0.4 mm and 1.5 mm. Further, the body component may have a thickness in a range between 0.2 mm and 0.7 mm. Preferably, the thickness of the middle component is at least 0.1 mm greater than the thickness of the body component. Thus, the middle wall may handle forces caused by the paintball gun, while the body component may be broken without causing too much damage to individuals in the paintball game.

The body component can have supports on an inner surface of the front portion. Therefore, the middle component can be placed on the supports and, hence, be supported by said supports.

A method for manufacturing the projectile may comprise the following steps:

- supplying a body component having a front portion and a body portion,
- applying a fill into the front portion of the body component,
- preferably, shaking the body component in order to level the fill out,
- supplying a middle component having a first side and a second side, and inserting the middle component into the interior volume of the body component so that the first side of the middle component is facing the interior volume of the front portion, and the second side of the middle component is facing the interior volume of the body portion, thereby forming a closed cavity and an open cavity,
- applying a sealing agent on the second side of the middle component, thereby obtaining a barrier layer on the middle component, and
- optionally, drying the barrier layer, thereby obtaining the projectile.

Thanks to the present invention, several advantages may be obtained. The novel projectile may have a single piece body component. The body component may form uniform front and side walls and provide suitable protection from a paintball gun, particularly together with the middle component. Further said body component may have a smooth outer surface, which may provide improved aerodynamic performance. Surface roughness of the smooth outer surface has preferably Ra value of less than 0.1 μm.

Still further, the body component may have lower strength properties than the middle component, hence, the projectile may provide suitable protection from a paintball gun while the projectile may not damage individuals when used in a paintball game.

Moreover, the projectile may be environmentally friendly due to biodegradable and/or inert non-toxic materials. There is high demand for biodegradable paintball projectiles in the market. The novel projectile may be made of biodegradable materials. The novel projectile may comprise e.g. biocomposites comprising bioplastic and cellulose based fibers. The projectile may also be environmentally friendly due to a simple manufacturing process. Thus, the projectile according to the specification may be manufactured in an environmentally friendly way.

Further, the projectile may be manufactured cost efficiently. During a manufacturing process of the novel projectile, the projectile may be easily filled with a fill, after which the cavity comprising the fill may be easily closed and sealed in order to form a barrier layer preventing an evaporation of the fill. The fill, the barrier layer, the body component, and the middle component may be made of non-toxic, biodegradable materials.

BRIEF DESCRIPTION OF THE DRAWINGS

In the following, the invention will be described in more detail with reference to the appended drawings, in which:

FIGS. 6*a-d* show some photos from experimental tests.

Figure 1A:
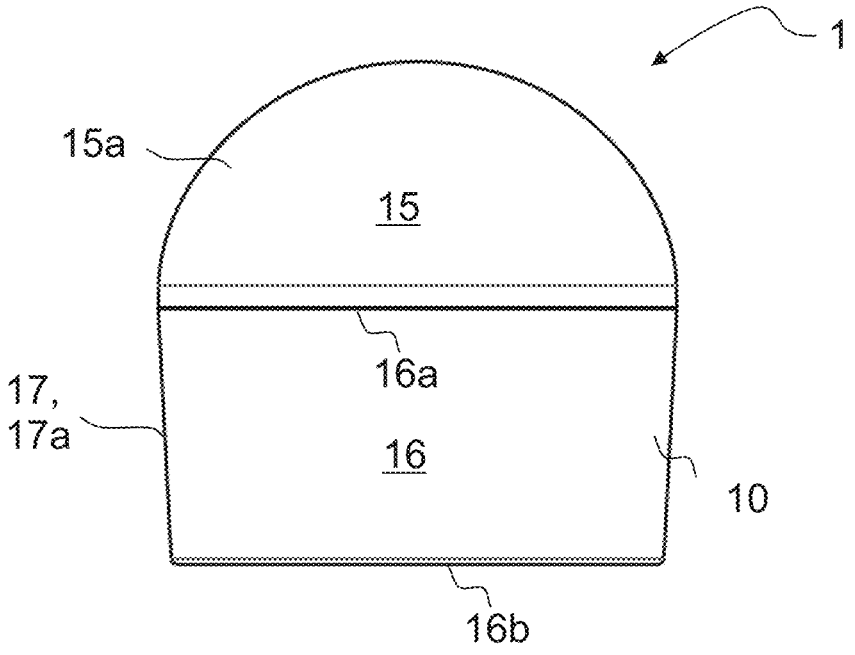
FIGS. 1*a-b* show a projectile according to an embodiment.

The figures are schematic and are intended to illustrate the general principles of the disclosed solution. Therefore, the illustrations in the Figures are not necessarily in scale or suggestive of precise layout of system components.

DETAILED DESCRIPTION OF THE INVENTION

The solution is described in the following in more detail with reference to some embodiments, which shall not be regarded as limiting.

In this application, reference is made to Figures, in which the following reference numerals are used:

1 projectile,
10 body component,
10*a* raw material for body component,
11 length of the body component,
12 diameter of the body component,
15 front portion,
15*a* outer surface of the front portion,
16 body portion,
16*a* first end of the body portion,
16*b* second end of the body portion,
17 side wall,
17*a* outer surface of the side wall,
20 middle component,
20*a* raw material for middle component,
30 closed cavity,
31 fill,
32 support for a middle component,
35 open cavity
40 sealing agent,
41 barrier layer,
80 forming a sheet,
85 cutting the middle component from the sheet,
90 injection molding,
100 supplying a body component,
110 applying fill into the body component,
120 inserting a middle component,
130 sealing the middle component, and
140 drying the projectile.

In this application, the term 'comprising' may be used as an open term, but it also comprises the closed term 'consisting of'.

In this application, percentage values relating to an amount of a material are percentages by weight (wt. %) unless otherwise indicated. All percentages refer to dry weight unless otherwise indicated.

The term "non-lethal projectile" refers to a projectile which intends to minimize a (permanent) personal damage.

The term 'projectile 1' refers to a shaped paintball projectile. The projectile may have a hemispherical front surface. Further, the projectile may have a cylindrically shaped side wall. The cylindrically shaped side wall may, or may not, taper from the first end 16*a* of the body portion to the second end 16*b* of the body portion. In this application, the term 'projectile' does not refer to lethal projectiles.

Figure 2:
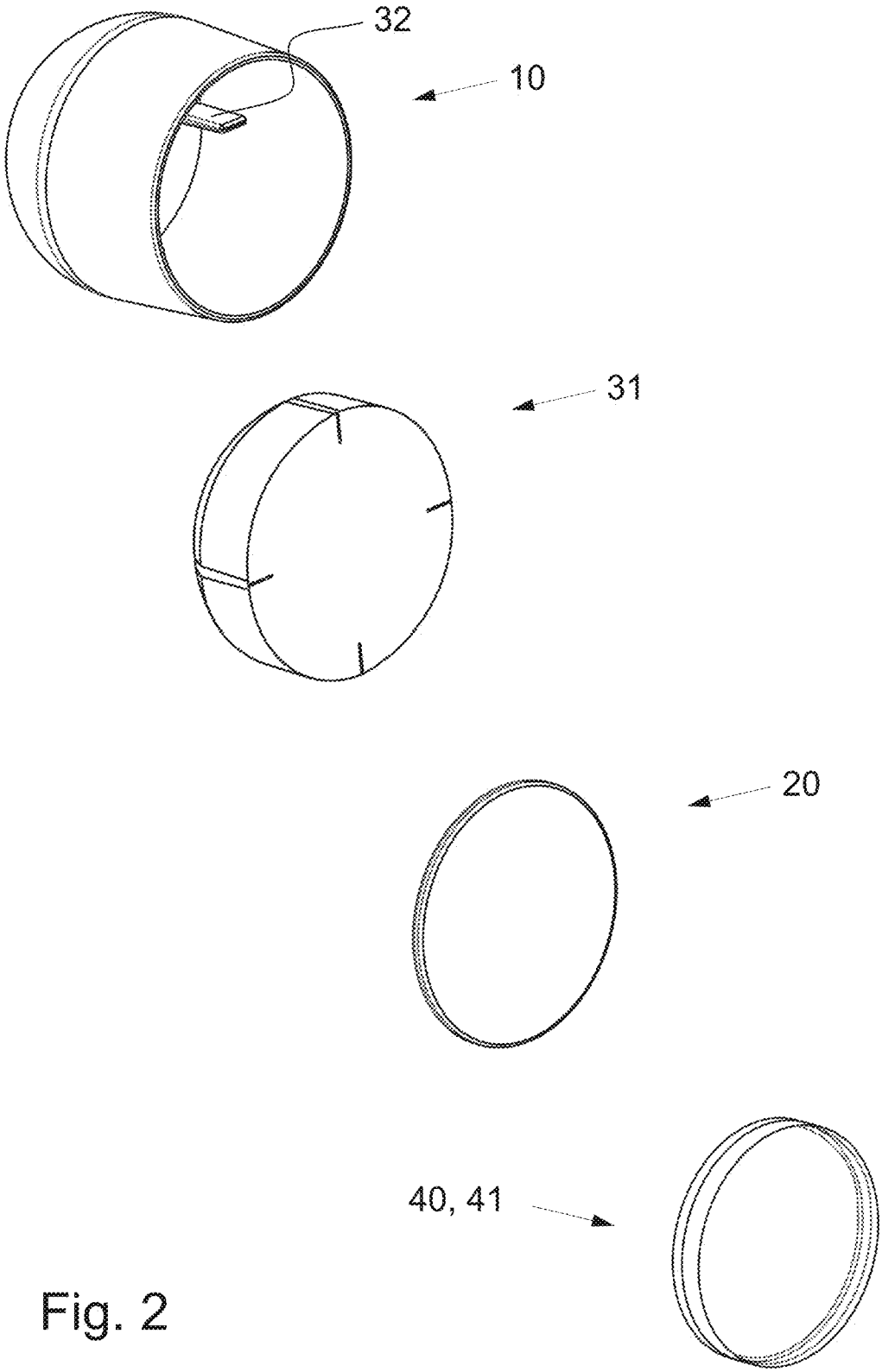
FIG. 2 shows an example structure of components.

The projectile 1 can comprise a body component 10 and a middle component 20 (see e.g. FIG. 2). The middle component 20 is preferably placed to the interior volume of the body component 10.

The term "body component 10" may refer to a single piece forming outer surfaces of the front wall and the side wall. The body component 10 may have a smooth outer surface. Preferably, the body component is a single piece forming substantially smooth outer surfaces of the front and side wall.

Surface roughness of the outer surface of the body component has preferably Ra value of equal to or less than 0.20 μm, more preferably less than 0.15 μm, and most preferably equal to or less than 0.10 μm, for example between 0.05 μm and 0.1 μm.

Figure 1B:
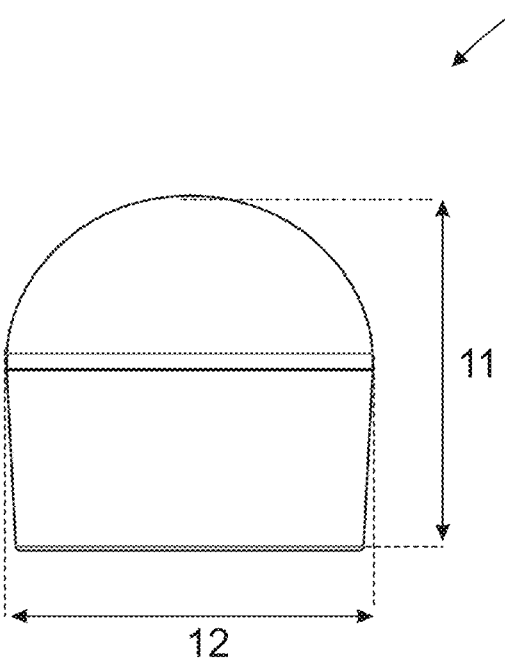
Figure 1C:
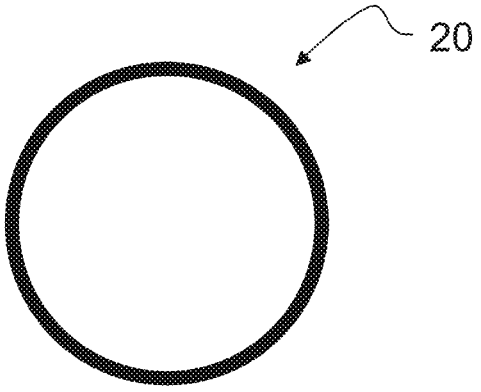
FIG. 1*c* shows an example of a middle component.

The side wall of the body portion is preferably a hollow cylindrically shaped wall formed by the body component 10. The side wall may taper from the first end 16*a* of the body portion to the second end 16*b* of the body portion. If the side wall tapers from the first end 16*a* of the body portion to the second end 16*b* of the body portion, an angle between a non-tapered line and the outer surface of the side wall may be between 1° and 5°, preferably equal to or more than 2°, more preferably equal to or more than 2.4°, and most preferably equal to or more than 2.7°. Further, the angle between the non-tapered line and the outer surface of the side wall may be equal to or less than 5°, preferably equal to or less than 4°, more preferably equal to or less than 3.5°, and most preferably equal to or less than 3.0°. The non-tapered line is shown e.g. in FIG. 1*b*. The term "middle component 20" may refer to a piece dividing interior volumes of the front portion 15 and the body portion 16. The middle component 20 can close a cavity 30 of the front portion 15.

The terms "biopolymer" and 'biodegradable polymeric material' both refer to biodegradable biobased polymers, such as bioplastics. The biodegradable polymeric material may comprise cellulosic material(s). Thus, the term 'bioplastic' may refer to different kinds of bioplastics, such as PLA, or bioplastics made from cellulose and/or a derivative of cellulose.

The terms 'cellulosic material' and "cellulose based material" are used as synonyms referring to any cellulose containing material(s). The cellulose-based material may be of wood origin, and/or it may comprise other than wood-based natural fibers. In this application, the term cellulose-based material particularly refers to materials, such as fibers, which are of non-wood origin. Thus, the projectile preferably comprises cellulose based materials, such as cellulose based fibers, which are of non-wood origin.

The cellulosic material may also comprise bioplastic(s) made from raw material containing cellulose and/or a derivative of cellulose.

The term "mineral filler" refers to an inert and non-toxic mineral filler, such as calcium carbonate. The biodegradable material may comprise mineral filler(s).

The term "closed cavity" refers to a space having solid walls. The projectile can have at least one closed cavity. Preferably, the projectile has only one closed cavity.

The term "open cavity" refers to a space having a solid side wall, one closed end, and one open end.

The projectile may have an open cavity. Preferably, the projectile has only one open cavity. The open cavity may have an open rear end.

'Shellac' is a resin of a bug (lac bug) origin. It is commercially available, typically in a form of dry flakes. The solid form of shellac may be dissolved in ethanol to make liquid shellac, from which the ethanol may be evaporated to form a solid layer. Shellac may be used to form a hard barrier layer with good barrier properties.

Unless otherwise stated, the following standards refer to methods which may be used in obtaining stated values of parameters:

ASTM E96 Water Vapor Transmission of Materials

ASTM F1249 Standard Test Method for Water Vapor Transmission Rate Through Plastic Film and Sheeting Using a Modulated Infrared Sensor ISO 15106-2 Plastics—Film and sheeting—Determination of water vapor transmission rate.

ASTM D5338 Biodegradability

Water vapor transmission rate of the projectile is preferably small in order to protect the fill of the projectile. In an advantageous example, the water vapor transmission rate of the front portion of the body component is equal to or less than 100 g/m$^2$ in a day (24 h). In an example, the body component is made of material(s) having small water vapor transmission rate. In an example, the inner surfaces of the front portion of the body component are coated by using material(s) lowering the water vapor transmission rate. Such coating materials may include, for example, shellac. Thus, in an embodiment, the inner surface of the front portion comprises a layer comprising shellac.

The projectile may have a biodegradability of 90% in 6 months as defined in the standard ASTM D5338. In an embodiment, the biodegradability of the projectile (in 6 months) is at least 80%, preferably at least 85%, more preferably at least 90%, and most preferably at least 95 wt. %.

Projectile; a Structure

The projectile 1 comprises a front portion 15 and a body portion 16.

The body portion 16 may comprise a cylindrical side wall 17 having an inner surface and an outer surface 17*a*. Preferably, the side wall 17 is tapered from the first end 16*a* of the body portion to the second end 16*b* of the body portion. The first end of the body portion can be adjacent to the middle component. The second end of the body portion can be the rear end of the projectile.

The front portion 15 may have an outer surface 15*a* and an inner surface. As shown e.g. in FIG. 2, the inner surface of the front portion 15 may have a support structure comprising supports 32 for the middle component.

Therefore, the body component 10 may have supports 32 on its inner surface for the middle component. The supports 32 may be on the inner surface of the front portion. The support structure may be formed so that the middle component 20 may be placed on and supported by the supports 32. The body component 10 may have at least 3 supports 32 for the middle component 20, such as 3 to 8 supports 32, preferably from 4 to 6 supports 32 for the middle component. Thanks to the supports, the middle component (i.e., the middle wall) may not collapse into the fill when the projectile is in use and gas hits the projectile. Further, the supports 32 may offer an easy way to place the middle component to the correct height.

The interior volume of the projectile 1 can be divided by the middle component 20 into the front portion 15 and the body portion 16. The front portion 15 may comprise at least a hemispherical nose portion.

The front portion 15 may be a hemispherical front portion and, hence, it may form a hemispherical interior volume.

The middle component may be placed on said supports 32 of the body component to close the hemispherical interior volume.

The outer surface 15*a* of the front portion 15 may be formed by the body component. The outer surface of the front portion may have a smooth outer surface. Surface roughness of the outer surface of the front portion may have Ra value of equal to or less than 0.20 μm, more preferably less than 0.15 μm, and most preferably equal to or less than 0.10 μm, for example between 0.05 μm and 0.1 μm. Thus, the outer surface 15*a* of the front portion 15 may not have e.g. a fill hole or other unevenness on said outer surface. This may improve aerodynamic performance of the projectile. Further, this may help to obtain improved strength properties for the paintball projectile. Furthermore, some loading problems of paintball guns may be avoided.

The side wall 17 of the body portion 16 may have a smooth outer surface. Surface roughness of the side wall may have Ra value of equal to or less than 0.20 μm, more preferably less than 0.15 μm, and most preferably equal to or less than 0.10 μm, for example between 0.05 μm and 0.1 μm. Thus, the outer surface 17*a* of the side wall 17 may not have e.g. wings or other unevenness on the surface. This may improve aerodynamic performance of the projectile because e.g. defects in the wings cannot influence the aerodynamic performance of the projectile.

Projectiles for paintball guns need to maintain, at least mainly, their shape and integrity during firing. Further, to working properly, the projectiles for paintball guns may need to disintegrate or disperse upon impact with a target at speed at which the paintball strikes a target. The novel projectile may have substantially firm shape having suitable strength properties for paintball projectile.

Therefore, the projectile 1 may have the front portion 15 and the body portion 16. The front portion may comprise the front wall, and the body portion may comprise the side wall. The side wall is preferably a cylindrical side wall.

The projectile may comprise:

- a body component 10, which is preferably a single piece forming outer surfaces 15*a*, 17*a* of the front portion 15 and the side wall 17,
- a closed cavity 30 in the interior volume of the front portion 15,
- a fill 31 in the closed cavity 30,
- an open cavity 35 in the interior volume of the body portion 16, and
- a middle component 20 in the interior volume of the body component, the middle component having a first side and a second side, wherein

- the first side of the middle component 20 is facing the closed cavity 30,
- the second side of the middle component is facing the open cavity 35, and
- the projectile further comprises a barrier layer 41 on the second side of the middle component 20.

Thus, the projectile 1 may comprise:

- the front portion 15 having the closed cavity 30,
- the body portion having the open cavity,
- the middle component 20, preferably placed on supports 32, the middle component dividing the interior volumes of the front portion and the body portion, and
- the barrier layer on the middle component 41 sealing the closed cavity.

The interior volume of the front portion 15 and the interior volume of the body portion 16 may be on different sides of the middle component 20, adjacent the middle component 20.

As discussed, the projectile 1 may have two main solid parts, i.e. the body component 10 and the middle component 20. Further, the body component 10 may have the fill 31 inside the front portion, and the fill may be in contact with the first side of the middle component. Still further, the middle component 20 may have a barrier layer 41 on the second side of the middle component.

The projectile 1 may comprise only one closed cavity 30 and only one open cavity 35. The closed cavity/cavities preferably comprise a fill.

The body portion 16 may comprise the open cavity 35. Thus, the interior volume of the body portion may have an open rear end. Therefore, the open cavity 35 can be open in the second end 16*b* of the body portion. Further, the open cavity 35 can be closed in the first end 16*a* of the body portion 16 by the middle component 20.

The weight of the projectile may be in a range between 0.5 g and 6.0 g, more preferably in a range between 2 g and 4 g and most preferably in a range between 3.1 g and 3.4 g. Further, the projectile may have a caliber between .40 and .75. The projectile may be, e.g. 50 caliber's projectile or 68 caliber's projectile, but also other calibers can be used.

The projectile may have good strength properties. To test the projectile impact strength the following test setup may be used:

- The impact area is a smooth stone surface, preferably a granite surface plate.
- The projectile is dropped to this plate from various heights so that only gravity and air resistance affect its terminal velocity.
- The test is conducted in a normal room temperature of 20 to 25° C.

The projectile preferably comprises the following strength properties:

1) When the projectile is dropped from a height of 1 meter to the granite surface plate, the projectile should not brake or have any cracks.
2) When the projectile is dropped from a distance of 2.5 meters to the granite surface plate, the projectile should crack so that a visible crack can be noted on the projectile front surface.

Projectile; Materials

For environmental reasons, the projectile may comprise biodegradable raw materials in a range between 90 wt. % and 100 wt. %, preferably in a range between 95 wt. % and 100 wt. %, more preferably equal to or more than 99 wt. %, and most preferably exactly 100 wt. % calculated from the total weight of the projectile.

The projectile may comprise at least 40 dry wt. % and equal to or less than 80 dry wt. % bioplastic(s). Further, the projectile may comprise at least 10 wt. % and equal to or less than 55 dry wt. % cellulose-based fibers. Further, the projectile may comprise inert, non-toxic mineral fillers and additives. The amount of additives may be equal to or less than 5 wt. %, preferably equal to or less than 3 wt. %, and most preferably equal to or less than 1 wt. %, calculated from total dry weight of the projectile. The additives may improve the manufacturing process of the projectile and/or the properties of the projectile.

Bioplastics are bio-based and biodegradable plastics. Bioplastics may be made from renewable biomass, such as cellulose, hemicellulose, lignin, vegetable fats and oils, starch, sugars, fish scales, insects, mushrooms, etc.

Biodegradability of the bioplastic means that the plastic is capable to biodegrade or decompose back into its natural elements under an action of bacteria and/or enzymes. Further, the biodegradation preferably refers to a process that starts without human intervention, i.e., it is not the same as composting, and the residue does not need to be compost. Bioplastics may not require adding catalysts for biodegradation.

Preferably, the biodegradable polymer is a polymer that fulfill standard ASTM D5338. The final products of aerobic degradation of biopolymers may comprise carbon dioxide and water, and they may further comprise mineral salts, and/or biomass.

Advantageously, the projectile comprises biocomposites comprising equal to or less than 55 dry wt. % of cellulose based fibers, preferably in a range between 20 dry wt. % and 50 dry wt. %, calculated from the total dry weight of the projectile, and bioplastic(s) equal to or more than 40 dry wt. %, calculated from the total dry weight of the projectile.

The cellulose-based materials, such as cellulose based fibers and cellulose based bioplastics, may reduce the needed amount of other raw materials, such as other kind of plastics. Further, cellulosic material may be environmentally friendly solution because the cellulose is biodegradable. Further, in some cases, the usage of cellulose based materials may reduce pollution. Further, the cellulose-based material may improve some properties of the body and middle components.

The body component and the middle component may comprise biocomposites comprising one or more bioplastics and cellulose based fibers. Advantageously, the body component and the middle component are made of biocomposites comprising one or more bioplastics and cellulose based fibers.

Most advantageously, the body component and the middle component comprise biocomposites and a first biocomposite of the body component differs from a second biocomposite of the middle component.

Bioplastic originating in biomass may reduce environmental load. Among biomass, cellulosic material may cause improved properties for the projectile as well as stable supply. Thus, the bioplastic may comprise cellulosic material originating from cellulose based material. Therefore, the projectile may comprise bioplastic(s) made from material(s) containing cellulose and/or a derivative of cellulose. Cellulose is typically non-thermoplastic material having strong hydrogen bonds within and between molecular chains. However, the cellulosic material may be plasticized. A person skilled in the art knows how to obtain bioplastics comprising cellulose-based material(s). Thus, the projectile may comprise cellulose based fibers and/or plasticized cellulose.

Alternatively, or in addition to the bioplastic(s) originating from cellulose based material, the projectile may comprise one or more bioplastics selected from the following group:

polylactic acid (polylactide),
thermoplastic starch,
polyvinyl alcohol,
biopolyester, and
polyhydroxyalkanoate PHA.

The preferred cellulose for the cellulose based fibers may include agricultural waste (i.e., biomass), grasses and/or other plant materials, such as straw, flowers, bark, leaves, seeds, legumes, tops, or fruit, which have been obtained from cotton, bagasse, corn, wheat, oat, rye, flax, hemp, manila hemp, sisal hemp, jute, ramee, kenaf hemp, barley, coffee, bamboo, rice and/or reed.

In this application, the preferred cellulose fibers for the projectile are based on coffee grounds and/or bamboo. Thus, the projectile preferably comprises cellulose based fibers from bamboo and/or coffee grounds. Most preferably, to obtain environmentally friendly projectile which may have improved properties for the projectile, the body component comprises fibers from coffee grounds and the middle component comprises fibers from bamboo.

Preferably, the projectile comprises one or more bioplastics, and cellulose based fibers from at least two different cellulose sources, preferably from bamboo and coffee grounds.

The projectile 1 may comprise non-toxic mineral fillers. Mineral fillers may decrease the manufacturing costs of the projectile. Further, mineral fillers may decrease the strength of the projectile, hence, the damage level to individuals may be decreased. Mineral fillers may comprise, for example, clay, calcined clay, natural ground calcium carbonate, precipitated calcium carbonate, talc, calcium sulphate, and/or titanium dioxide.

In an embodiment, the total mineral filler content of the projectile may be 0 to 10%, preferably at least 1%, such as in a range between 1% and 9% and more advantageously at least 2%, such as in a range between 2% and 8%, calculated from the total dry weight of the projectile. In this embodiment, the projectile may not comprise more than 10 wt. % mineral fillers because otherwise mineral fillers may decrease strength properties of the projectile too much. The strength properties of the projectile typically improve as the amount of mineral fillers decreases. If the projectile comprises mineral fillers, the projectile preferably comprises precipitated calcium carbonate and/or ground calcium carbonate as a filler.

The projectile may further comprise other components, such as processing agents, preferably up to 1 dry wt. %, calculated from the total dry weight of the projectile The bioplastic may also comprise mixtures of the above-mentioned alternatives for improving properties of the projectile. However, at least the body component, preferably also the middle component, may comprise biocomposite(s) comprising bioplastic and cellulose based fibers.

Projectile; a Body Component

The body component 10 may be a single piece forming outer surfaces of the front portion 15 and the side wall 17. An example of the body component 10 is shown e.g. in FIG. 2.

The body component may be e.g. injection molded as a single piece.

Figure 3A:
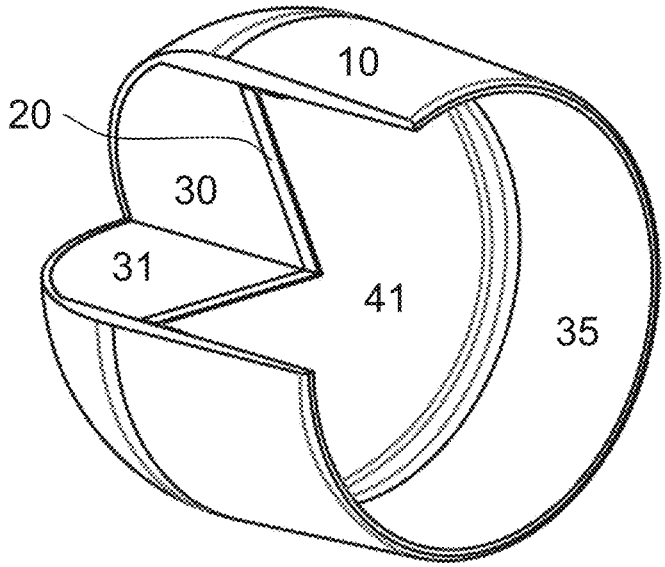
FIG. 3*a* illustrates an example of a projectile in a cutaway angle view.
Figure 3B:
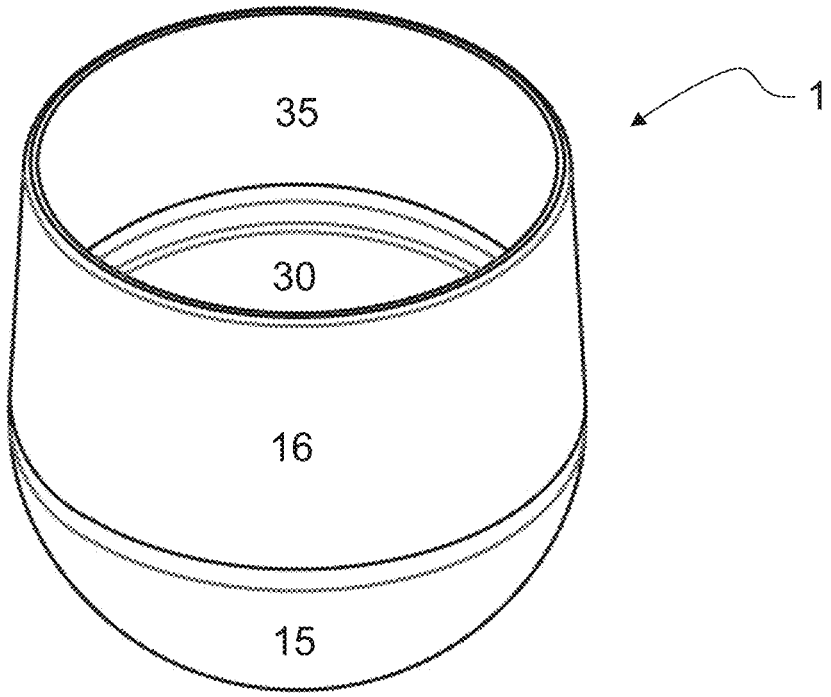
FIG. 3*b* shows a projectile according to an embodiment.

The body portion 16 (shown e.g. in FIGS. 1*a* and 3*b*) may be a cylindrical portion comprising a cylindrical side wall. The side wall may have an inner surface and an outer surface 17*a*. The body portion 16 may form a cylindrical interior volume.

The cylindrical shape may taper from the first end 16*a* of the body portion to the second end 16*b* of the body portion. Thus, the body portion 16 may have a general form of a (hollow) cylindrical frustum.

The projectile may have a length 11 and a diameter 12 and a thickness.

The diameter 12 of the projectile may be at least 16.5 mm, preferably equal to or more than 17 mm, more preferably equal to or more than 17.2 mm and most preferably equal to or more than 17.3 mm, calculated as a maximum diameter (i.e., width) of the projectile (typically a diameter of the first end 16*a* of the body portion). Further, the diameter 12 of the projectile may be equal to or less than 18 mm, preferably equal to or less than 17.7 mm, and most preferably equal to or less than 17.4 mm, calculated as a maximum diameter of the projectile (typically a diameter of the first end 16*a* of the body portion). Said diameters may be particularly advantageous for the paintball projectile.

Further, the body portion may taper from a first end 16*a* of the body portion to the second end 16*b* of the body portion. Thus, the body portion 16 may have a first diameter 12 in the first end 16*a* of the body portion and a second diameter in the second end 16*b* of the body portion, wherein the second diameter is smaller than the first diameter. The second diameter may be, for example, 0.2-1.1 mm smaller than the first diameter. This may improve the aerodynamical properties of the projectile.

The diameter of the second end 16*b* may be at least 15.8 mm, preferably equal to or more than 16.1 mm, more preferably equal to or more than 16.3 mm, and most preferably equal to or more than 16.4 mm. Further, the diameter of the second end 16*b* may be equal to or less than 18 mm, preferably equal to or less than 17.3 mm, more preferably equal to or less than 16.8 mm, and most preferably equal to or less than 16.6 mm. Said diameters may improve the aerodynamical properties of the projectile.

The length 11 of the projectile may be at least 15 mm, preferably equal to or more than 16 mm, more preferably equal to or more than 17 mm, and most preferably equal to or more than 17.3 mm, calculated as a maximum length of the projectile from the front end to the rear end. Further, the length 11 of the projectile may be equal to or less than 19 mm, preferably equal to or less than 18.5 mm, more preferably equal to or less than 18 mm, and most preferably equal to or less than 17.5 mm, calculated as a maximum length of the projectile from the front end to the rear end. Said length may improve the aerodynamical properties of the projectile as well as improve the usability of the projectile.

A length of the body portion 16 from the first end 16*a* of the body portion to the second end 16*b* of the body portion (i.e., from the middle wall to the rear end of the projectile) may be at least 6.5 mm, preferably equal to or more than 7 mm, more preferably equal to or more than 7.5 mm, and most preferably equal to or more than 7.8 mm, calculated from the first end 16*a* of the body portion to the rear end 16*b*. Further, the length of the body portion 16 from the first end 16*a* to the second end 16*b* may be equal to or less than 9.5 mm, preferably equal to or less than 9 mm, more preferably equal to or less than 8.5 mm, and most preferably equal to or less than 8.1 mm, calculated from the first end 16*a* of the body portion to the rear end 16*b*. Said length of the body portion may be particularly advantageous for properties of the paintball projectile and it may improve the easiness of usability as well as aerodynamical properties of the projectile.

A length of the front portion 15 may be at least 7.5 mm, preferably equal to or more than 8 mm, more preferably equal to or more than 8.5 mm, and most preferably equal to or more than 8.7 mm, calculated from the front surface of the projectile to the first side of the middle component. Further, the length of the front portion may be equal to or less than 9.7 mm, preferably equal to or less than 9.2 mm, more preferably equal to or less than 9.0 mm, and most preferably equal to or less than 8.8 mm, calculated from the front surface of the projectile to the first side of the middle component. Said length of the front portion may be particularly advantageous for properties of the paintball projectile and it may improve the easiness of usability as well as aerodynamical properties of the projectile. Further said length may, together with the diameter of the projectile, provide particularly suitable volume for the fill of the projectile.

A thickness of the wall of the front portion may differ from a thickness of the wall of the body portion 16. Alternatively, the thickness of the front portion may be the same as the thickness of the body portion 16.

A thickness of the body component 10 may be in a range between 0.2 mm and 0.7 mm. The thickness of the body component 10 is preferably at least 0.2 mm, such as in a range between 0.2 mm and 0.6 mm, more preferably at least 0.3 mm, such as in a range between 0.3 mm and 0.6 mm, and most preferably equal to or less than 0.5 mm, such as in a range between 0.3 mm and 0.5 mm. Thus, the body component comprising bioplastic, preferably cellulosic material, most preferably cellulosic material from coffee grounds, may have good strength properties for paintballs so that the projectile may have such strength that it is sufficient to hold the projectile under firing stress while readily bursting upon impact with the target. Said effects may be easier to control than conventionally due to the one piece forming the outer surfaces of the nose and the side wall.

As discussed, the thickness of the wall of the front portion 15 may differ from the thickness of the wall of the body portion 16. A thickness of the body portion may be in a range 0.2 mm and 0.7 mm. The thickness of the body portion is preferably at least 0.2 mm, such as between 0.2 mm and 0.6 mm, more preferably at least 0.3 mm, such as between 0.3 mm and 0.6 mm, and most preferably equal to or less than 0.5 mm, such as between 0.3 mm and 0.5 mm. Thus, the projectile comprising bioplastic and cellulose based fibers, most preferably cellulose based material from coffee grounds may have good strength properties for paintballs so that the projectile may have such strength that it is sufficient to hold the projectile under firing stress.

Further, a thickness of the front portion may be in a range between 0.2 mm and 0.7 mm. The thickness of the front portion is preferably at least 0.2 mm, such as between 0.2 mm and 0.6 mm, more preferably at least 0.3 mm, such as between 0.3 mm and 0.6 mm, and most preferably equal to or less than 0.5 mm, such as between 0.3 mm and 0.5 mm. Thus, the projectile comprising bioplastic and cellulose based material, most preferably cellulosic material from coffee grounds may readily burst upon impact with the target.

As discussed, the side wall 17 and the wall of the front portion 15 are preferably formed by the body component 10. Thus, the body component 10 can be one piece forming the outer surface 15*a* of the front portion as well as the side wall of the body portion 16.

Advantageously, the body component 10 has a smooth outer surface. Thus, the outer surface of the body component 10 (including the front portion 15 and the side wall of the body portion 16) may be smooth or at least substantially smooth. Thus, the body component 10 may not have e.g. so-called wings. The outer surface having said shape may be easily manufactured without defects on the outer surface of the projectiles. For example, injection molding of the wings may not be easy due to the shape of the wings, hence, defects in wings may affect aerodynamic performance of the projectile.

Thanks to the smooth outer surface of the projectile 1, the aerodynamic performance of the projectile may be easily controlled so that the aerodynamic performance may be similar for each manufactured projectile.

In this application, the term "smooth surface" means that a surface roughness of the smooth (outer) surface has preferably Ra value of less than 0.20 μm, more preferably less than 0.15 μm, and most preferably less than 0.10 μm, for example between 0.05 μm and 0.1 μm. Ra value is an arithmetical mean deviation. In this application, Ra values are shown in micrometers (μm).

Further, thanks to the smooth outer surface, manufacturing costs of the projectile may be decreased. Further, because the outer surface does not have difficult formations, there may not be defects on the outer surface of the projectile influencing the properties of the projectile. For example, wings may be quite hard to form without defects by using material comprising cellulose-based material. These defects may be avoided with the substantially smooth, wingless, outer surface. Therefore, thanks to the substantially smooth outer surface, defects affecting aerodynamic performance of the projectile may be avoided.

Further, preferably, the front portion of the projectile has the smooth or substantially smooth outer surface. Thus, the front portion of the projectile may not have e.g. a filling hole or any other kinds of discontinuities, but the outer surface of the front portion preferably consists of the body component 10. Thus, the front portion is preferably without a (covered) hole. The technical effect of the smooth outer surface 15*a* is that the front portion may not have a nipple that could cause feeding issue in use. Further, the front portion of the body component 10 may be airtight because there is not any hole that could cause poor barrier properties. This may be particularly advantageous when the front portion comprises cellulose based fibers.

The body component 10 is preferably manufactured from non-toxic, biodegradable materials. The body component 10 may comprise biodegradable polymers and non-toxic filler (s). The body component 10 may comprise cellulose based fibers.

The content of the cellulose-based fibers in the body component 10 can be at least 20 wt. %, more preferably at least 30 wt. % and most preferably at least 40 wt. %, calculated from the total weight of the body component. Further, the content of said cellulose based fibers in the body component 10 can be equal to or less than 60 wt. %, more preferably equal to or less than 55 wt. %, and most preferably equal to or less than 50 wt. %, calculated from the total dry weight of the body component 10. The cellulose-based fibers are biodegradable. Further, in some cases, the usage of cellulose based material may reduce pollution. Further, the cellulose-based material may have good properties for the body component, e.g. it may reduce the strength properties of the projectile so that the projectile may not damage individuals in a paintball game.

The cellulose-based fibers in the body component 10 may comprise cellulose-based fibers from coffee grounds. Coffee grounds contain cellulose, which can be used in the projectile. The content of the coffee grounds-based fibers in the body component 10 can be at least 20 wt. %, more preferably at least 30 wt. % and most preferably at least 40 wt. %, calculated from total weight of the body component. Further, the content of said coffee grounds-based material in the body component 10 can be equal to or less than 60 wt. %, more preferably equal to or less than 55 wt. %, and most preferably equal to or less than 50 wt. %, calculated from the total dry weight of the body component 10.

In an embodiment, the body component 10 is injection molded from biocomposite(s) comprising cellulose-based fibers at least 30 wt. %, which cellulose-based fibers preferably comprise materials obtained from coffee grounds.

The body component 10 may comprise at least one bioplastic selected from the group comprising:

polylactic acid (polylactide) PLA,
thermoplastic starch,
polyvinyl alcohol,
biopolyester,
polyhydroxyalkanoate PHA, and
bioplastic originating from cellulose based material.

These bioplastics may be particularly suitable to be used together with cellulose based fibers. Preferably, the body component comprises at least 20 wt. %, more preferably at least 30 wt. %, and most preferably at least 40 wt. % the above-mentioned biopolymer(s). Further, the body component may comprise equal to or less than 65 wt. %, more preferably equal to or less than 55 wt. %, and most preferably equal to or less than 50 wt. % the above-mentioned biopolymers. The body component should be strong enough to be used with a paintball gun, but the strength properties should not be too good because the projectile should not damage players of the paintball game.

In an advantageous embodiment, the body component comprises at least 20 wt. %, more preferably at least 30 wt. %, and most preferably at least 40 wt. % PLA (polylactic acid). Further, the body component may comprise equal to or less than 60 wt. %, more preferably equal to or less than 50 wt. %, and most preferably equal to or less than 50 wt. % PLA (polylactic acid). The polylactic acid has particularly good properties for the projectile together with cellulose based fibers. Thanks to the PLA, the body component may be strong enough to be used with a paintball gun, but the strength properties may not be too good for the projectile.

The body component preferably comprises a total amount of bioplastic(s) and cellulose fibers equal to or more than 80 wt. %, preferably between 90 wt. % and 100 wt. %, or between 95 wt. % and 99.9 wt. %

In an embodiment, the body component 10 may comprise mineral fillers in a range between 0 wt. % and 10 wt. %, preferably in a range between 1 wt. % and 5 wt. %, calculated from the total weight of the body component 10. The usage of the mineral fillers may improve some properties of the projectile as well as decrease the manufacturing costs of the projectile. The usage of the mineral fillers may, for example, decrease the strength of the body component. Thus, the non-lethal projectile used in paintballs may not hurt the target as much as conventional projectiles. However, the projectile needs to be strong enough to be used with the paintball gun. Thus, because the mineral fillers typically decrease strength properties of the projectiles, the mineral content of the projectiles may not be too high.

In an example, the body component 10 comprises, for example, talc and/or calcium carbonate. In an example, the total content of said talc and/or calcium carbonate is less than 10 wt. %, for example in a range between 1 wt. % and 5 wt. %. Talc and calcium carbonate may be preferred mineral fillers for the body component 10 due to properties of said fillers. Further, they may be cost effective alternative for raw materials.

The body component 10 may not have any coating layers on the outer surface of the body component. Thanks to the simple structure and cost-effective materials, it is possible to decrease manufacturing costs of the projectile.

The body component may have a weight in a range between 0.6 g and 0.9 g, more preferably in a range between 0.65 g and 0.85 g, and most preferably in a range between 0.7 g and 0.8 g.

Projectile; an Inner Structure

The projectile may have one closed cavity 30, the closed cavity 30 comprising a fill. The projectile may further have one open cavity 35. Thus, only part of the inner volume of the body component 10 may be filled with the fill.

The interior volume of the front portion 15 can form the closed cavity 30. Preferably, the interior volume of the front portion forms only one closed cavity 30. Preferably, the closed cavity 30 comprising the fill 31 may have a volume of equal to or more than 0.0009 liters, more preferably equal to or more than 0.0010 liters, and most preferably equal to or more than 0.0011 liters. Further, the closed cavity 30 comprising the fill 31 may have a volume of equal to or less than 0.0014 liters, more preferably equal to or more than 0.0013 liters, and most preferably equal to or more than 0.0012 liters.

The interior volume of the body portion 16 can form an open cavity. The open cavity may have an open second side 16*b*, hence, the second end of the body portion may be open. Further, the first end 16*a* of the body portion may be closed by the middle component.

Therefore, the inner volume of the body portion 16 may form an unfilled, open cavity. Further, the inner volume of the front portion 15 may form a filled, closed cavity 30.

Projectile; a Middle Component

The projectile can comprise the middle component 20 between the interior volumes of the front portion 15 and the body portion 16. Thus, the middle component 20 may be placed between the front portion and the body portion. Preferably, the middle component is placed between the hemispherical portion of the projectile and the cylindrical portion of the projectile. Thus, the middle component 20 may be in a form of a middle wall between the interior volumes of the front portion 15 and the body portion 16.

Therefore, the middle component 20 may form a middle wall between the interior volume of the front portion 15 and the interior volume of the body portion 16. Thus, the middle component 20 may be a middle wall inside the body component 10. The middle component 20 may be shaped like a disc. Therefore, the middle component may be used to close the interior volume of the closed cavity formed inside the body component (10).

The middle component 20 has a first side and a second side. Preferably, the first side of the middle component 20, is facing the interior volume of the front portion 15, and the second side of the middle component 20 is facing the interior volume of the body portion 16. The front portion is preferably a hemispherical portion, and the body portion is preferably a cylindrical portion, which may taper from the first end of the body portion to the second end of the body portion.

The middle component 20 may have a thickness between 0.3 mm and 1.6 mm. The thickness of the middle component may be equal to or more than 0.4 mm, preferably equal to or more than 0.5 mm, more preferably equal to or more than 0.6 mm, and most preferably equal to or more than 0.7 mm. Further, the thickness of the middle component may be equal to or less than 1.5 mm, preferably equal to or less than 1.2 mm, more preferably equal to or less than 1.0 mm, and most preferably equal to or less than 0.8 mm. Thus, the middle component may have a good strength so that the projectile can be used with paintball gun. The thickness of the middle component is preferably at least 0.1 mm greater than the thickness of the front portion of the body component, more preferably at least 0.2 mm greater than the thickness of the front portion of the body component. Thus, the middle component may provide good strength for the projectile so that the projectile can be used with paintball gun while the body component may provide decreased strength properties to the projectile so that the projectile may not damage individuals in the paintball game.

The middle component 20 is preferably manufactured from a non-toxic, biodegradable materials. In an advantageous embodiment, the middle component 20 comprises a different bioplastic and/or cellulose based fibers compared to the body component 10. Thus, due to the different raw materials, improved properties may be obtained for the body component as well as for the middle component 20.

The middle component 20 may comprise biodegradable polymer(s) and non-toxic filler(s). The middle component 20 may comprise cellulosic material. Advantageously, the middle component 20 is biodegradable. In an example, the middle component 20 comprises bioplastic, and cellulose based fibers which cellulose based fibers are from bamboo.

The content of cellulose-based fibers in the middle component 20 can be at least 2 wt. %, more preferably at least 5 wt. % and most preferably at least 10 wt. %, calculated from the total weight of the middle component. Further, the content of the cellulose-based fibers in the middle component 20 can be equal to or less than 25 wt. %, more preferably equal to or less than 20 wt. %, and most preferably equal to or less than 15 wt. %, calculated from the total weight of the middle component 20. The amount of the cellulose-based fibers in the middle component is preferably smaller than the amount of cellulose-based fibers in the body component, because the middle component should have better strength properties than the body component. The middle component needs to have good strength so that the projectile can be used with paintball guns. Further, the body component should not damage individuals in the paintball game. The cellulose-based fibers have an effect on the strength properties of the projectile.

Advantageously, the content of cellulose-based fibers originating from bamboo in the middle component 20 can be at least 2 wt. %, more preferably at least 5 wt. % and most preferably at least 10 wt. %, calculated from the total weight of the middle component. Further, the content of said cellulose-based fibers from bamboo can be equal to or less than 25 wt. %, more preferably equal to or less than 20 wt. %, and most preferably equal to or less than 15 wt. %, calculated from the weight of the middle component 20.

The middle component 20 may comprise be at least one bioplastic from the group comprising:

polylactic acid (polylactide),
thermoplastic starch,
polyvinyl alcohol,
biopolyester,
polyhydroxyalkanoate PHA, and
bioplastic originating from cellulose based material.

These biopolymers may be particularly suitable to be used together with cellulose based fibers. The middle component may comprise at least 30 wt. %, preferably at least 50 wt. %, more preferably at least 70 wt. %, and most preferably at least 80 wt. % the above-mentioned biopolymer(s). Further, the middle component may comprise equal to or less than 95 wt. %, more preferably equal to or less than 90 wt. %, and most preferably equal to or less than 85 wt. % the above-mentioned biopolymers. The middle component should be strong enough to be used with a paintball gun, hence, the amount of said bioplastics is preferably quite high.

Most preferably, the middle component may comprise at least 30 wt. %, preferably at least 50 wt. %, more preferably at least 70 wt. %, and most preferably at least 80 wt. % PLA. Further, the middle component may comprise equal to or less than 95 wt. %, more preferably equal to or less than 90 wt. %, and most preferably equal to or less than 85 wt. % PLA. The polylactic acid has particularly good properties for the projectile together with cellulose based fibers. The middle component should be strong enough to be used with a paintball gun, hence, the amount of said biopolymers is preferably quite high.

The middle component preferably comprises a total amount of biopolymers and cellulose based fibers equal to or more than 80 wt. %, preferably between 90 wt. % and 100 wt. %, or between 95 wt. % and 99.9 wt. %

In an embodiment, the middle component 20 may comprise mineral fillers in a range between 0 wt. % and 10 wt. %, preferably in a range between 0 wt. % and 3 wt. %, calculated from the total weight of the middle component 20. The usage of the mineral fillers may decrease the manufacturing costs of the projectile. However, the middle component 20 needs to be strong enough to be used with paintball guns. Thus, because the mineral fillers typically decrease strength properties of the middle component 20, the mineral content of the middle component 20 may not be too high.

The middle component may have a weight in a range between 0.15 g and 0.29 g, more preferably in a range between 0.18 g and 0.26 g, and most preferably in a range between 0.20 g and 0.24 g.

Projectile; a Fill

The closed cavity 30 comprises a fill. The fill 31 may comprise water as a main raw material. Preferably, the fill 31 comprises colored water having washable, non-toxic liquid dye. Upon impact with an individual, the front portion 15 of the projectile may at least partially disintegrate to mark said individual with the fill.

Thus, the fill 31 may be water-based fill 31 comprising washable, non-toxic dye. The marking substance (i.e., the dye) is preferably a water-based paint. The water content of the fill 31 may be in a range between 30 wt. % and 45 wt. %, more preferably in a range between 34 wt. % and 40 wt. %, and most preferably in a range between 35 wt. % and 39 wt. %.

The total amount of the water in the fill may be in a range between 0.6 g and 1.0 g, more preferably in a range between 0.7 g and 0.9 g, and most preferably in a range between 0.75 g and 0.85 g.

The marking substance may be at least one of a group comprising a pigment, a powder dye, a liquid dye, a water-soluble dye, and ultraviolet dye. Preferably the marking substance is washable, water-soluble, non-toxic biodegradable material. The marking substance may be e.g. a food dye. Marking substances used in paintball projectiles are known to a skilled person.

The fill 31 may further comprise a thickening agent and a weighting agent.

The thickening agent may comprise laponite. Thus, preferably, the fill 31 comprises colored water and laponite. The thickening agent may be used to improve the rheological properties of the fill. Laponite performance advantage is its shear thinning properties causing the fill to become less vicious upon impact which increases its marking capabilities. Thus, thanks to the water and laponite, marking capabilities of the projectile may be improved. The amount of the thickening agent, such as the laponite, may be, e.g. from 1 to 5 wt. % of the fill. The fill 31 is preferably selected such that the fill 31 does not separate over time into a thickening agent and a liquid. Said separation might cause unbalance on the projectile.

The weighting agent may be used to increase the weight of the fill 31 and, hence, to improve the properties of the projectile. The projectile may comprise weighting agents e.g. up to 45 wt. % calculated from the total weight of the projectile.

The weighting agent may be barium sulfate ($BaSO_4$). It may be good for manufacturing and transportation costs to reduce the weight of the projectile. However, to obtain improved aerodynamic performance, the fill 31 preferably comprises said barium sulfate. The amount of the barium sulfate may be from 55 wt. % to 68 wt. %, preferably from 58 wt. % to 65 wt. %, and most preferably in a range between 60 wt. % and 63 wt. % of the fill, calculated from the total weight of the fill including water. The technical effect is that the projectile may be stable to the penetration of the air due to the fill 31 comprising barium sulfate. Further, the fill comprising barium sulfate may have an improved effect while landing on the target.

The total amount of the barium sulfate in the projectile may be in a range between 1.1 g and 1.6 g, more preferably in a range between 1.2 g and 1.5 g, and most preferably in a range between 1.3 g and 1.4 g. Barium sulfate may improve the aerodynamic performance of the projectile. Further, barium sulfate may improve the biodegradability of the projectile. Thus, advantageously, barium sulfate is added as a weighting agent to the fill 31 to provide the appropriate weight for the fill 31 as well as improved aerodynamic performance for the projectile.

The fill 31 may have a weight in a range between 1.9 g and 2.5 g, more preferably between 2.0 g and 2.4 g and most preferably between 2.1 g and 2.3 g, such as 2.2 g, calculated as total weight of the fill including water. The weight/density may depend on raw material(s) as well as amount of the fill 31 within the body component 10. The fill has a strong effect on the properties of the projectile.

The fill 31 is preferably selected such that the fill 31 does not separate over time into separate agents and a liquid. Said separation may cause unbalance on the projectile. Thus, most preferably, the fill 31 comprises of consists of colored water, barium sulfate and laponite.

During a manufacturing process of the projectile, the fill may be introduced into the interior volume of the front portion via the second end of the body portion.

Projectile: a Barrier Layer

The projectile may comprise a barrier layer 41. A sealing agent 40 may be used to form the barrier layer 41.

The barrier layer may hold the middle component 20 in the place (preferably together with supports 32) as well as stop the evaporation of the fill. Thus, advantageously, the closed cavity 30 is sealed with a sealing agent 40 in order to form the barrier layer 41. Thanks to the barrier layer 41, the projectile may be tightly sealed.

Therefore, the sealing agent 40 may seal the closed cavity 30, which closed cavity 30 is filled with the fill 31 and closed by the middle component 20. Thanks to the sealing agent 40 forming the barrier layer 41, the fill 31 may not evaporate. Further, improved protection from water and air can be obtained with the barrier layer 41.

The sealing agent 40 (and hence the barrier layer 41) may comprise shellac. The shellac can form a good barrier layer 41 onto the second side of the middle layer 20, providing a water barrier between the fill 31 and the air. Shellac is a bio resin, that has been produced by a bug, hence, shellac is biodegradable material. Therefore, the shellac, which may provide good waterproofness and airtightness, is also biodegradable.

The shellac is preferably placed on the second side of the middle component 20, i.e., the outer surface of the middle component 20 facing the open cavity of the projectile. Thus, thanks to the shellac used as a sealing agent 40, the biodegradable projectile may have improved barrier properties.

Advantageously, the content of the shellac is equal to or more than 95 wt. %, more preferably equal to or more than 99 wt. % and most preferably equal to or more than 99.9 wt. %, such as exactly 100 wt. %, calculated from the total dry weight of the barrier layer 41. Further, the content of said shellac can be equal to or less than 100 wt. % calculated from the total dry weight of the barrier layer.

Advantageously, the total weight of the shellac is equal to or more than 0.05 g, more preferably equal to or more than 0.10 g and most preferably equal to or more than 0.15 g, calculated from the total dry weight of the barrier layer 41. Thus, it is possible to obtain improved barrier properties for biodegradable projectile. The shellac may be a quite expensive component. Thus, preferably the projectile does not comprise too much shellac. Therefore, the total weight of said shellac can be equal to or less than 0.50 g, more preferably equal to or less than 0.25 g, and most preferably equal to or less than 0.20 g, calculated from the total dry weight of the barrier layer.

Projectile: An Example of a Manufacturing Method

Figure 5A:
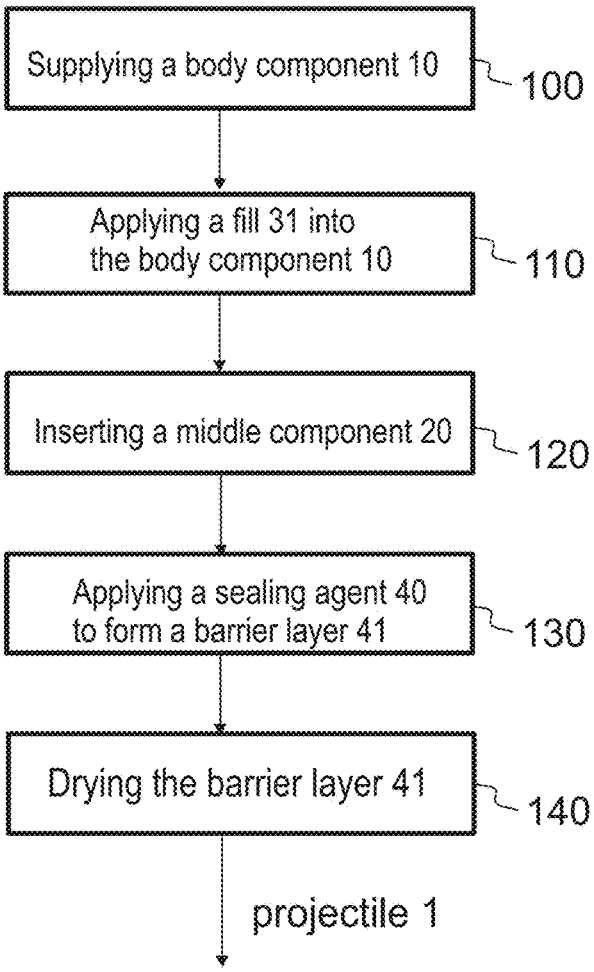
FIGS. 5*a-c* illustrate some example steps for manufacturing a projectile.
Figure 5B:
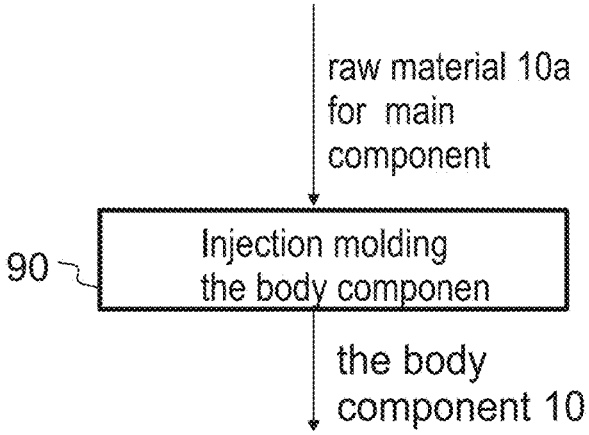
Figure 5C:
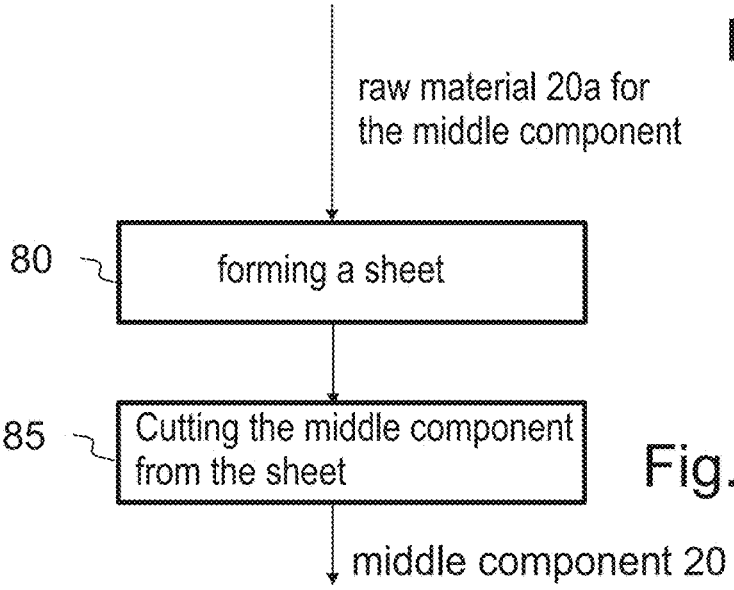

FIGS. 5*a-c* illustrate some example steps for manufacturing the projectile.

A method for manufacturing a paintball projectile may comprise the following steps:

providing a body component (10) having a front portion and a body portion, applying a fill (31) into the front portion (15) of the body component (10), preferably, shaking the body component 10 to level the fill out, adding a middle component (20) into the interior volume of the body component (10), thereby forming one closed cavity (30) comprising the fill, applying a sealing agent (40) on the middle component (20), thereby obtaining a barrier layer (41) on the middle component, and optionally, drying the barrier layer, thereby obtaining the projectile.

The projectile may be efficiently manufactured due to the structure of the projectile. Further, thanks to the preferred materials of the projectile, the projectile may be safe to the environment.

As discussed, the sealing agent 40 may comprise the shellac. Thus, the shellac may be the main material of the barrier layer 41. The barrier layer may further comprise e.g. coloring agent. This coloring agent may be UV activated so that the projectile, flying at night, can be seen.

The sealing agent 40, when applied onto the second side of the middle component 20, may further comprise ethanol. The ethanol may make e.g. the shellac to form substantially uniform barrier layer onto the middle component 20. After the sealing agent 40 is applied onto the middle component 20, the ethanol may be evaporated (i.e., the formed layer may be dried).

The body component 10 may be molded, preferably injection molded. Therefore, the body component 10 may have been made by using a molding technique, preferably an injection molding technique. The body component 10, which can comprise the front portion 15 and the body portion 16, may be an injection molded body component 10.

The step 'providing a body component 10' may comprise the following steps:

supplying raw material 10*a* for the body component 10, and injection molding the body component 10, thereby obtaining the body component 10.

The body component 10 may be made of an injection moldable biodegradable material. Preferably, the body component comprises injection moldable bioplastic(s) and cellulose-based fibers.

In injection molding, a biodegradable raw material in a solid state is converted to a molten state and injected into a mold. Thus, the mold is filled with the raw material. The biodegradable raw material may be heated to have suitable properties for the injection, after which the polymer cools down and forms the body component. The aim of the injection molding may be to produce cost efficiently a thin body component 10 having a smooth outer surface and good properties for the projectile.

Thanks to the injection molding, it is possible to obtain a thin, uniform wall structure which can disintegrated upon impact with an individual.

The middle component 20 is preferably shaped like a disc. The middle component 20 may have been formed e.g. by die cutting it out of a material sheet. The material sheet may comprise e.g. biodegradable polymer(s) and other components discussed above.

The middle component may have a diameter equal to, or substantially equal to, an inner diameter of the body component in the location of the middle component.

The step 'providing a middle component' may comprise the following:

supplying raw material(s) 20*a* for the middle component, forming a sheet from the raw material(s), and cutting the middle component from the sheet, thereby obtaining the middle component.

The step 'applying a sealing agent 40 on the middle component' may comprise the following steps:

weighting the projectile, and applying the sealing agent 40 on the second side of the middle component to obtain a desired weight for the projectile.

In this embodiment, when calculating the desired weight for the projectile while applying the sealing agent, the weight to be removed from the projectile, e.g. via evaporation (such as ethanol from the sealing agent 40) is preferably taken into account.

As discussed above, the body component 10 and/or the middle component 20 can also contain other agents, for example coloring agents, such as pigments, including UV activated coloring agents.

Furthermore, as discussed above, the body component 10 and/or the middle component 20 may contain inert raw materials, such as talc, calcium carbonate, titanium dioxide, and/or carbon black.

The projectile may also comprise one or more other materials than the above described materials.

Example 1

The novel projectiles were manufactured according to the following steps:

injection molding a body component from a biocomposite comprising i) bioplastic, and ii) cellulose based fibers from coffee grounds, cutting a middle component 20 from a biocomposite sheet comprising i) bioplastic, and ii) cellulose based fibers from bamboo, applying a fill 31 into the body component to a predetermined level, shaking the body component to level the fill out, adding the middle component 20 into the body component to form a closed cavity 30 to the interior volume of the body component, applying a sealing agent comprising shellac and ethanol on the middle component 20 to seal the closed cavity 30, and drying the sealing agent in order to obtain a barrier layer.

Figure 4A:
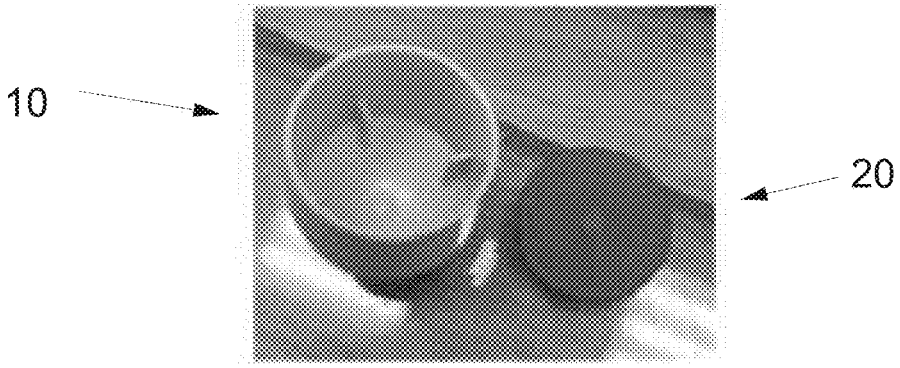
FIGS. 4*a-c* show some photos from experimental tests.
Figure 4B:
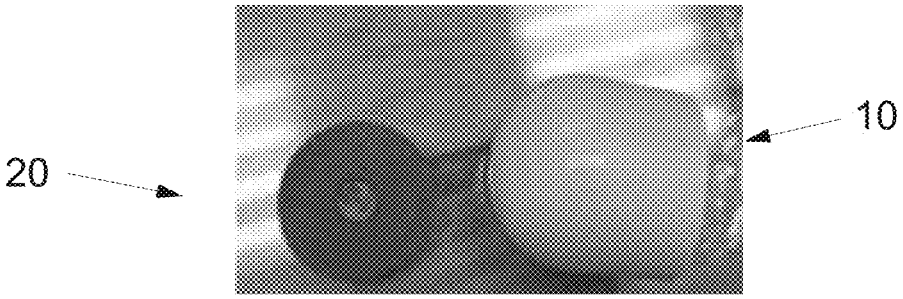
Figure 4C:
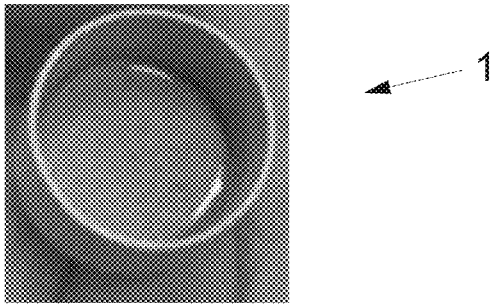

FIGS. 4*a-b* show an example of the manufactured body and middle components. FIG. 4*c* shows an example of the projectile having the sealing agent on the middle component 20.

Example 2

Marking capabilities of the novel projectiles manufactured according to the Example 1 were compared with reference paintball projectiles. The reference paintball projectiles were one of the leading paintball projectiles in the market.

These results are shown in FIGS. 6*a*-6*b*. FIG. 6*a* shows the novel projectile, and FIG. 6*b* shows the reference projectile. The projectiles were shot at a concrete wall from 15 m distance from the wall. Velocity of the shots was between 270 FPS and 280 FPS. It was noted that the marking area of the novel projectiles was much larger than marking area of the reference products.

Example 3

The projectiles were tested for accuracy by shooting them through a paintball marker mounted on a shooting vise. A distance between the paintball gun and the wall was 70 meters.

The results of the novel projectiles were compared with test results of reference samples. The reference samples were from one of the leading paintball projectiles in the market.

The manufactured projectiles were suitable to be fired with a paintball gun. Further, the novel projectiles had at least as good accuracy as the reference samples. The results are shown in FIGS. 6*c* and 6*d*, wherein FIG. 6*c* shows the results of the novel projectiles, and FIG. 6*d* shows the results of the reference samples. It was noted that the marking areas of the novel projectiles were larger and had better shapes than marking areas of the reference samples.

Example 4

Finally, the novel projectiles, which were manufactured according to the Example 1, were tested for impact strength. The reference samples were of one of the leading paintball projectiles in the market.

Tests were conducted at a room temperature of 25° C., and at a relative humidity of 60%. Projectiles to be tested were unpacked and left on the open for 2 hours before testing. Tests were done by dropping the projectiles to a smooth concrete surface at various heights and observing the surface of each dropped projectile. Any crack was considered to be a broken shell.

When projectiles were dropped from a height of 1 meter, most of the novel projectiles as well as most of the reference products were not broken at all.

When the novel projectiles were dropped from a height of 2.5 m, 90% of the novel projectiles had very good brakes with lots of fragments. Thus, the novel projectiles had suitable strength for paintball games. Thus, the novel projectiles were showing a consistent braking at a desired force level.

On the contrary, when the reference samples were dropped from a height of 2.5 m, 60% of the reference projectiles were undamaged.

The novel projectile may have several advantages. The barrier layer of the projectile may keep the fill inside the body component as well as provide good waterproofness and prevent the fill from evaporation. Furthermore, the novel projectile, despite of these excellent properties, may be fully or at least partly biodegradable. For example, the cellulose-based materials may be disintegrated, via intermediate steps, e.g. to water, mineral salts, biomass, and carbon dioxide.

Still further, the novel projectile may have excellent strength properties. The projectile may have such a strength that it is suitable to be used with paintball guns due to the suitable strength of the middle component, while the front portion may have such decreased strength properties that the projectile may not be damaging individuals when used in a paintball game. Particularly, the novel projectile can be fragile since the nose, which may have uniform, substantially smooth outer surface and cellulose-based fibers and which may not have a filling hole, can be substantially thin.

Furthermore, the body component may comprise such materials that the projectile cannot be easily seen by a target, while the middle layer and the barrier layer may comprise such materials that the projectile can be easily seen by the shooter.

Moreover, the novel projectile having a simple construction and e.g. water-based fill, may be cheaper and easier to make than conventionally, thus, the production costs may be decreased. Still further, the novel projectile, despite of the biodegradability, simple structure, and other above-mentioned advantages, may fly at least as well as conventional projectiles, particularly due to the structure having substantially smooth outer surface as well as suitable materials.

The invention is not limited solely to the examples presented in Figures and the above description, but it may be modified within the scope of the appended claims.

What is claimed is:

1. A non-lethal projectile comprising a body component, which is a single piece having a uniform continuous structure forming outer surfaces of a hemispherical front portion, and a body portion comprising a side wall, a closed cavity in an interior volume of the hemispherical front portion, a fill in the closed cavity, and a middle component in the interior volume of the body component, the middle component being a disc-shaped middle wall inside the body component, and the middle component having a first side and a second side, wherein the first side of the middle component is facing the closed cavity, the projectile further comprises an open cavity in an interior volume of the body portion, and the projectile further comprises a barrier layer on the second side of the middle component.

2. The projectile according to claim 1, wherein the second side of the middle component is facing the open cavity, and the middle component is placed between the hemispherical front portion and the open cavity.

3. The projectile according to claim 1, wherein
the body component comprises a first biocomposite comprising first cellulose based fibers, and
the middle component comprises a second biocomposite comprising second cellulose based fibers,
wherein the first cellulose-based fibers differ from the second cellulose-based fibers.

4. The projectile according to claim 1, wherein the body component comprises cellulose based fibers in a range between 20 wt. % and 60 wt. %, calculated from total weight of the body component.

5. The projectile according to claim 4, wherein the cellulose based fibers of the body component comprise fibers from coffee grounds.

6. The projectile according to claim 1, wherein the middle component comprises cellulose based fibers in a range between 5 wt. % and 25 wt. %, calculated from total weight of the middle component.

7. The projectile according to claim 6, wherein the cellulose based fibers of the middle component comprise fibers from bamboo.

8. The projectile according to claim 1, wherein the body component comprises at least one bioplastic selected from the group consisting of:
polylactic acid (polylactide) PLA,
thermoplastic starch,
polyvinyl alcohol,
biopolyester,
polyhydroxyalkanoate PHA, and
bioplastic originating from cellulose based material.

9. The projectile according to claim 1, wherein the middle component comprises at least one bioplastic selected from the group consisting of:
polylactic acid (polylactide) PLA,
thermoplastic starch,
polyvinyl alcohol,
biopolyester,
polyhydroxyalkanoate PHA, and
bioplastic originating from cellulose based material.

10. The projectile according to claim 1, wherein the barrier layer comprises shellac.

11. The projectile according to claim 1, wherein the body component has a smooth outer surface.

12. The projectile according to claim 11, wherein surface roughness of the outer surface of the front portion has an arithmetical mean deviation (Ra value) of equal to or less than 0.20 μm.

13. The projectile according to claim 11, wherein surface roughness of the outer surface of the side wall has an arithmetical mean deviation (Ra value) of equal to or less than 0.20 μm.

14. The projectile according to claim 1, wherein the side wall is a cylindrical side wall.

15. The projectile according to claim 1, wherein the fill is water-based fill comprising non-toxic dye comprising
barium sulfate, and/or
laponite.

16. The projectile according to claim 1, wherein
the middle component has a thickness in a range between 0.4 mm and 1.5 mm, and/or
the body component has a thickness in a range between 0.2 mm and 0.7 mm.

17. The projectile according to claim 1, wherein the body component has supports on an inner surface of the front portion, and the middle component is supported by the supports.

* * * * *